United States Patent [19]

Marin

[11] 4,193,189

[45] Mar. 18, 1980

[54] SCISSORS OR SIMILAR CUTTING TOOLS WITH PLASTIC HANDLES

[76] Inventor: Sergio Marin, Via Trento, Inverigo (Como), Italy

[21] Appl. No.: 925,623

[22] Filed: Jul. 17, 1978

[30] Foreign Application Priority Data

Sep. 27, 1977 [IT] Italy ..... 22375/77[U]

[51] Int. Cl.[2] ..... B26B 13/04

[52] U.S. Cl. ..... 30/260; 30/349

[58] Field of Search ..... 30/254, 260, 349

[56] References Cited

U.S. PATENT DOCUMENTS

| | | | |
|---|---|---|---|
| 1,628,856 | 5/1927 | Patrick | 30/349 |
| 1,632,525 | 6/1927 | Wilkes | 30/260 |
| 2,627,656 | 2/1953 | Richartz | 30/254 |
| 3,453,651 | 7/1969 | Wertepny | 30/254 |
| 3,750,282 | 8/1973 | Eaton | 30/254 |
| 3,880,021 | 4/1975 | Hannes | 30/254 X |

*Primary Examiner*—Jimmy C. Peters

*Attorney, Agent, or Firm*—Haseltine, Lake & Waters

[57] ABSTRACT

A scissors comprising first and second pivotably connected arms, each including a finger engaging portion and a remote tip portion. Each arm is constituted in entirety of a plastic material and has a recessed seat in which a metal blade is mounted. The blade is removably mounted in the seat by engagement of a hole in the blade with a corresponding projection on each arm in the respective seat from the bottom surface thereof. The projection is of truncated conical shape and the hole in the blade is sized and shaped to engage the respective projection and enable removal of the blade by the elasticity of the plastic material of the projection.

5 Claims, 3 Drawing Figures

SCISSORS OR SIMILAR CUTTING TOOLS WITH PLASTIC HANDLES

FIELD OF THE INVENTION

This invention relates to scissors or similar cutting tools with handles made of a plastic material.

SUMMARY OF THE INVENTION

The main object of this invention is the provision of scissors, in particular to large-size scissors suitable for being used by tailors, textile workers and others, with the scissors being kept in the hand for a long time (without thereby excluding the use of the tool also for other purposes by anyone desiring to use the scissors also for short times only), said scissors being specially characterized by their lightness though always ensuring the best cutting performance.

The scissors of this invention are based upon the hinge-like coupling of two handles entirely made of a pressed plastic material, said handles having suitable means for allowing the application and fixing in the required position of the required metal blades with the relative cutting edges opportunely oriented, it being understood that the application of the said blades to the said handles is either of the fixed or movable type.

The means for applying the metal blades to the handles made of a plastic material is advantageously made of stubbed seats with undercut sides and relief elements, suitably dimensioned, so that each metal blade can be made to cooperate with the respective lowered seat of the corresponding handle while pressure engaging said relief elements with the corresponding holes of said blade, the latter having an undercut side which, when the blade is applied to the corresponding handle, engages the undercut side of said seat, so that the blade is securely fixed to and held by the handle, the depth of the lowered seat and the thickness of the metal blade being the same so that the upper surface of the blade is at the level of the surface of the plastic handle adjacent to the lowered seat.

BRIEF DESCRIPTION OF THE DRAWING

The above and other features of this invention will be described in relation to the accompanying drawing, given by way of example and without limitation.

In the drawing.

DETAILED DESCRIPTION

Figures 1, 2, 3:
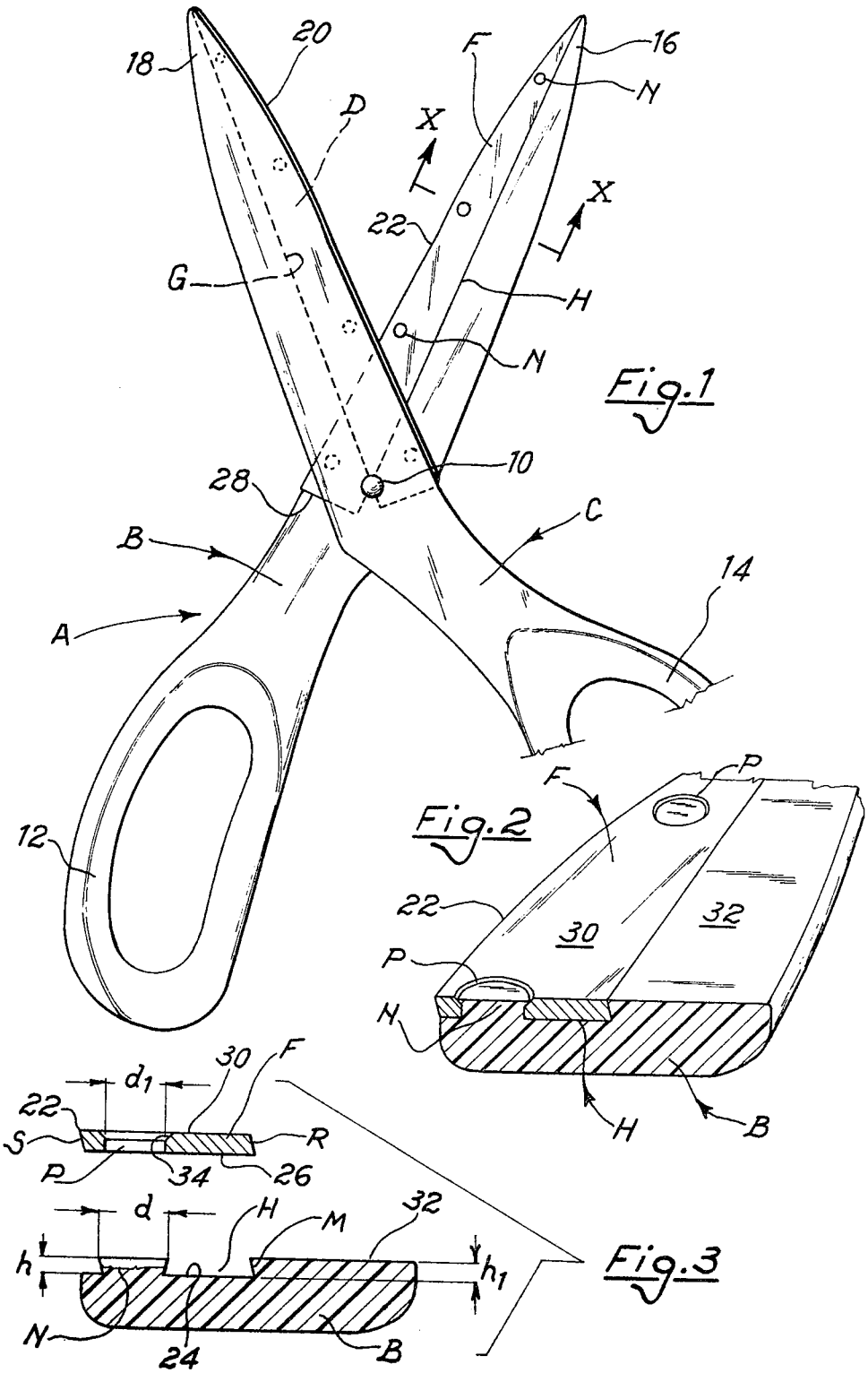
FIG. 1 is a plan view of the scissors of this invention with the handles in opened position.
FIG. 2 is an enlarged detail of a section taken along line X—X in FIG. 1.
FIG. 3 is a similar section with the blade shown separately from the seat in the handle.

With reference to the drawing, the scissors are formed by the hinge-like coupling of two arms B-C connected, as known, by a center pin 10 suitably inserted into respective holes in the arms and then riveted to the arms B-C. The arms B-C are entirely made of a pressed plastic material, the body of each arm, from the respective handle 12, 14 to the respective tip 16, 18 being constituted of a single pressed block. The plastic material has the required physical characteristics of mechanical resistance, wear resistance and the like and may be colored or capable of being chrome-plated; for example, the plastic material can be a polyamide.

The arms B-C are constructed to receive metal blades D-F having cutting edges 20-22 suitably oriented to allow the scissors to cut as required.

The metal blades D-F may be fitted to the plastic handles B-C either in fixed or removable manner so that, once applied to the handles the blades are fixed thereto or may be removed and replaced when worn, using in the latter case interchangeable blades.

According to an advantageous embodiment of the scissors according to this invention, each handle B-C is provided with a lowered seat or recess G-H for receiving the corresponding blade D-F.

The seat H in the handle B (and all that follows applies also to the seat G in the handle C) has a large supporting surface 24 for receiving the corresponding surface 26 of the metal blade F, said surface 24 being delimited longitudinally along the axis of the handle B by an undercut side M beginning at a cross edge 28 and ending at the tip 16 of the handle B.

The supporting surface 24 of the seat H is provided with projecting elements N consisting of the same plastic material as the swivel handle and constituting rivets or dowels for joining the metal blade F. In the illustrated embodiment have four rivets are shown.

These projecting elements have, if the blade is to be interchangeable, the form of a truncated cone whose larger base has a diameter d the height h of the truncated cone N being smaller than the depth $h_1$ of the recessed seat H.

The metal blade F, preferably of hardened and burnished steel is so shaped as to adapt itself perfectly into seat H. The blade has a supporting surface 26 coextensive with the surface 24 of the seat H and the blade, after having been fixed with respect to the seat H is perfectly aligned with the surface 32 of the arm B adjacent to the seat H, the thickness of said blade F being therefore equal to the depth $h_1$ of the seat H.

Finally, the blade F is delimited longitudinally at the inside by side R and, at the outside, by cutting edge S. The edge S intersects the surface 30, the form the cutting edge of the scissors 22.

The blade F has as many holes P as there are rivets N on the seat H, the diameter $d_1$ of each hole is smaller than the diameter d of the larger truncated cone base of each rivet N. Each hole P has at the upper part 30 an opportune chamfer 34 ensuring that the corresponding rivet N does not project beyond the surface 30 which is perfectly flush with the surface 32, the two surfaces being coplanar.

As already said, the description given for the seat H of the plastic handle B and for the metal blade F applied in this seat, is the same for the seat G and the blade D connected to the handle C.

It must also be noted that both of the handle finger openings, for gripping of the cutting shears A, has a double bevelled inside surface so that the shears can be used without difficulty by lefthanders.

In the illustrated embodiment, when the metal blades D-F are secured in the corresponding seats G-H, the assembling machine will develop a force causing the undercut surface R of the blade to come into contact with the undercut side M of the seat H thus producing a compressive force on the blade F so that the truncated cones N are keyed into the corresponding holes P; at the end of this operation, the blades F and D will be perfectly positioned in the seats H and G with the relative cutting edges 22 and 20 in the correct position and the surfaces 30 perfectly aligned with the surfaces 32.

In this case, when applying an opposed force onto the metal blades and overcoming the locking force of the cones N inserted into the holes P, the blades can be removed from the corresponding seats, for example, when worn at the cutting edges 20-22, and replaced by new blades.

If, however, the blades are fixed in another manner, for example, by punching them into the seats of the plastic-material handles, the blades will be integrally fixed to the handles and cannot be replaced.

The above description clearly shows the advantages of the cutting tool which are reiterated hereinafter.

Thanks to the conformation of the handles B-C made of a pressed plastic material in a single piece, the shears have a reduced weight as compared to that of conventional shears having handles entirely or partially made of metal, the weight being even only one-sixth of that of normal shears. This reduction in weight of the tool makes their transport in large quantities much easier and less costly.

The making of the handles of the shears by means of stamping from a plastic material is simple and has reduced cost.

The risk of rusting of the cutting edges is largely reduced and eliminated when the latter is made of a hardened and burnished steel.

The easy use of the shears according to this description is noteworthy and does not tire the user even after a long time of operation because of the reduced weight of the tool.

I claim:

1. A scissors comprising first and second pivotably connected arms, each arm including a finger-engaging portion and a remote tip portion, each said arm being constituted in entirety of a plastic material, each arm having a recessed seat, a metal blade for each arm, and means for removably securing the blade in a respective seat in each arm, said means comprising integral projections on each arm extending in each seat from the bottom surface thereof, said projections being of truncate conical shape, each blade being provided with a hole for receiving a respective projection, said hole being shaped to engage a respective projection and enable removal of the blades by the elasticity of the plastic material of the projection.

2. A scissors as claimed in claim 1 wherein each said hole is provided with a chamfer at the end thereof remote from the end which initially engages the projection when installed thereon.

3. A scissors as claimed in claim 2 wherein said blades and arms have upper surfaces which are in aligned, flush relation with the blades installed on said arms.

4. A scissors as claimed in claim 1 wherein said projection of truncated conical shape widens upwardly from said bottom surface of said seat.

5. A scissors as claimed in claim 4 wherein said projection has a an upper end with a diameter greater than the diameter of the respective hole in the blade.

* * * * *